United States Patent [19]

Miller

[11] Patent Number: 4,922,567

[45] Date of Patent: May 8, 1990

[54] TREATING FABRICS

[75] Inventor: Robert A. Miller, New Ringgold, Pa.

[73] Assignee: J. E. Morgan Knitting Mills, Inc., Tamaqua, Pa.

[21] Appl. No.: 373,103

[22] Filed: Jun. 28, 1989

[51] Int. Cl.[5] ..... D06B 3/10

[52] U.S. Cl. ..... 8/151; 8/159; 68/9; 68/13 R; 68/19.1; 68/158; 68/5 C; 68/177

[58] Field of Search ..... 68/13 R, 178, 179, 5 C, 68/5 D, 9, 19.1, 158, 177; 8/151, 150, 152, 159; 26/24, 30, 29

[56] References Cited

U.S. PATENT DOCUMENTS

| | | | |
|---|---|---|---|
| 2,581,018 | 1/1952 | Hatay | 26/18.5 |
| 2,655,711 | 10/1953 | Hatay | 26/18.5 |
| 2,733,498 | 2/1956 | Hatay | 26/18.5 |
| 2,808,635 | 10/1957 | Parker et al. | 28/74 |
| 3,077,655 | 2/1963 | Runton | 26/18.5 |
| 3,083,435 | 4/1963 | Cohn et al. | 26/18.6 |
| 3,090,666 | 5/1963 | Jones | 8/125 |
| 3,235,932 | 2/1966 | Jones | 26/18.5 |
| 3,447,885 | 6/1969 | Hasselkuss et al. | 8/17 |
| 3,593,546 | 7/1971 | Hasegawa et al. | 68/178 |
| 3,656,885 | 4/1972 | Gagliari | 8/116.3 |
| 3,730,679 | 5/1973 | Schuierer | 8/151 |
| 3,831,233 | 4/1975 | Cohn et al. | 26/18.5 |
| 3,915,632 | 10/1975 | Troope et al. | 8/125 |
| 4,031,596 | 6/1977 | Joy | 26/18.6 |
| 4,072,557 | 2/1978 | Schiel | 162/111 |
| 4,156,955 | 6/1979 | Joy | 26/18.6 |
| 4,162,563 | 7/1979 | Lawrence et al. | 28/163 |
| 4,247,969 | 2/1981 | Diggle, Jr. et al. | 26/18.6 |
| 4,345,385 | 8/1982 | Sando et al. | 34/23 |
| 4,373,362 | 2/1983 | Fleissner | 68/9 |
| 4,392,365 | 7/1983 | Miyamoto et al. | 68/177 X |
| 4,446,606 | 5/1984 | Lawrence et al. | 26/18.6 |
| 4,462,227 | 7/1984 | Wilson, Jr. et al. | 68/9 |
| 4,492,045 | 1/1985 | Boucraut | 34/122 |
| 4,644,765 | 2/1987 | Kito | 68/177 X |
| 4,678,693 | 7/1987 | Kemp | 26/29 R X |
| 4,716,744 | 1/1988 | Turner | 68/178 X |
| 4,731,893 | 3/1988 | Tanaka | 68/9 X |

*Primary Examiner*—Frankie L. Stinson

*Attorney, Agent, or Firm*—Dann, Dorfman, Herrell & Skillman

[57] ABSTRACT

A method for preshrinking tubular knit fabrics in which the fabric is treated as a continuous length in tubular form. The elongated tube is continuously fed lengthwise into a series of liquid baths which include a wetting agent, scouring and washing constituents and rinses and any finish is to be applied to the fabric. The fabric tube is caused to advance into and through the bath in a substantially tensionless state by pushing the fabric into the flow of liquid and through the bath to avoid applying substantial tension. From the washing and rinsing baths, the saturated fabric is flattened, again without application of substantial tension, and is fed through a two-stage dryer. In the initial stage, the fabric is air-dried to a moisture content of substantially less than 40%. Before introducing the fabric into the second stage of the dryer, the moisture content is raised, for example in a steam atmosphere, to substantially 40%. The final drying is performed in multiple steps to assure uniform treatment of the fabric throughout its length to ultimately reduce the moisture content in the fabric to less than 8%. The illustrated combination of apparatus for accomplishing the fabric treatment includes a relaxing and washing washing range, for the liquid treatment of the fabric, a padding apparatus for the flattening of the fabric while saturated, a drum-type air dryer for air-drying the fabric in the first stage, a steam chest intermediate stage in advance of the final dryer stage, and a tumble-type compartmentalized continuous length dryer in the final stage.

13 Claims, 3 Drawing Sheets

TREATING FABRICS

FIELD OF THE INVENTION

The present invention relates to a method and apparatus for the treatment of cotton fabrics, and is applicable to knit fabrics having a cotton content of between 40–100%. It is particularly effective for the treatment of insulating fabrics known as thermal knits.

BACKGROUND OF THE INVENTION

The conventional techniques for treating knitted fabrics in tubular form prior to cutting and sewing the fabrics into garments provides fabrics having residual shrinkage in the range of 25%. When the fabric is formed into garments and sold to the public, the fabric is normally oversized to some degree and as the garment is subjected to normal wear and washing, it shrinks. A tubular knit fabric is designed to stretch to conform to the body of the wearer, and the fact of cotton fabric shrinkage has been an accepted characteristic which the public must tolerate when seeking the advantage of cotton knit fabrics.

To control shrinkage, resins are applied to the fabric either during the fabric finishing operation or during the yarn preparation phase of the operation. Such treatment is expensive and eventually adversely affects the longevity of the fabric and detracts from the soft "hand" of the fabric. Furthermore, most resins contain formaldehyde which is deemed unsafe at certain levels in the workplace and on the product.

During the preparation of the knitting yarn and during the knitting operation, lubricants and waxes are used and other foreign matter may become entrapped in the fabrics which preferably should be removed before the fabric is made into garments. Commonly the fabric is separated into batches which are washed and dried individually in tumble washers and dryers. The handling of the batches of fabric while wet tends to impart stresses and strains to the fabric tubes, which strains may or may not be relieved during subsequent processing operations, and the resulting fabrics are characterized by shrinkage which is not uniform and which may vary in residual shrinkage from as low as 10% to as high as 25%.

In the case of thermal knit fabrics, the fabric is characterized by air-entrapping cells or pockets on one or both sides which provide dead air spaces in the fabric. These cells are produced by the knit construction during knitting of the fabric and are disposed in longitudinal and transverse rows. Known as "waffle knit" fabric, the development of thermal knit fabric since 1951 is briefly described in U.S. Pat. No. 4,678,693, the disclosure of which is incorporated herein by reference.

In a common type of thermal fabric, the knit construction provides in the neighborhood of 5.25 cells per inch in both the lengthwise and transverse direction and a typical density in the range of 5½ ounces per square yard. To counteract the effect of the residual shrinkage, the fabric has typically been subjected to compaction and setting with formaldehyde resin treatment.

In efforts to obtain more uniformity, the batch treatment has been replaced by continuous treatment, but it has been found that the conventional continuous treatment has resulted in residual shrinkage in the range of 25%. Attempts to reduce the shrinkage without chemical treatment of the fabric have previously been directed to the final stages of the finishing operations, specifically during the drying operation following the washing and scouring and other chemical treatment of the fabric after it comes from the knitting machines. Although such treatments reduce the residual shrinkage to some degree, none has proved entirely satisfactory.

SUMMARY OF THE PRESENT INVENTION

The present invention provides an improved method and a novel combination of apparatus which provide a finished fabric having a uniformly low residual shrinkage in the range of approximately 5–8%.

The method of the present invention contemplates the treatment of a continuous length of tubular knit fabric in substantially continuous operations of washing, rinsing, and drying in two stages with moisture control of the fabric prior to and during the final drying stage, all under controlled conditions of fabric relaxation.

More specifically, the present invention contemplates in the washing and rinsing operation handling of the fabric with a minimized application of tension or other stress to the fabric so as to subject the fabric to agitation in a bath of liquid without substantial tension or other stress to enable thorough relaxation of the fibers and yarns of the fabric to maximize shrinkage of the fabric while it is saturated in a liquid bath.

The saturated fabric is removed from the liquid bath with minimum application of tension and is flattened while still saturated with free and bound liquid so that it may thereafter be subjected to extraction in open tubular width to remove the free liquid. The fabric is then submitted to two stages of the drying, the first stage being air drying in open tubular width and the second stage being tumble-drying in open tubular width with a positive control of the moisture content of the fabric as it enters the tumble-drying stage and throughout the tumble-drying stage of the two-stage drying operation.

Specifically, in the tumble-drying stage of the operation, the fabric is introduced into the tumble dryer at 40% moisture content and the heat and moisture content of the drying medium is controlled throughout the tumble drying operation so as to reduce the moisture content of the fabric in controlled steps as the fabric advances through the tumble-drying operation, so that it is discharged at a moisture content of approximately 5% with residual shrinkage less than 8%.

BRIEF DESCRIPTION OF THE DRAWINGS

The objects of the invention are more fully set forth hereinafter in the following description taken in conjunction with the attached drawings, wherein.

DESCRIPTION OF THE PREFERRED EMBODIMENT

Figure 1:
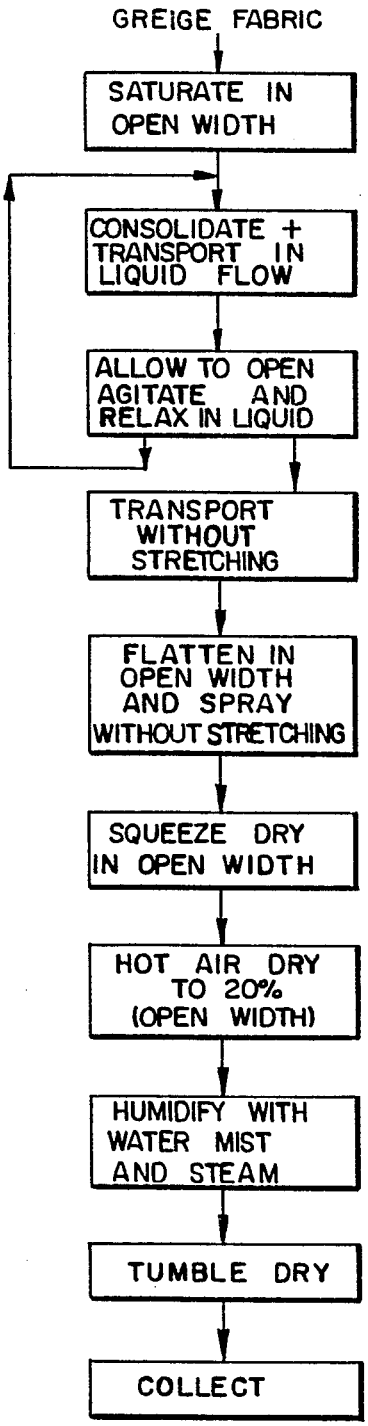
FIG. 1 is a diagram of the processing steps embodied in the method of the present invention.

Referring now to the drawings, FIG. 1 is a block diagram of the operational steps embodied in the method of the present invention. As described more fully hereinafter, the fabric from the knitting machine is first saturated and then caused to flow through a sequence of baths in a relaxing and washing range. In each bath the fabric is consolidated and caused to flow through the bath with the liquid so as to be immersed in the liquid throughout its travel. There is a longitudinal flow of liquid in the baths which assists the fabric to advance from the entrance end to the exit end of each bath. In its travel in the baths, the fabric is pushed through the bath rather than pulled through the bath, and, accordingly, the fabric tends to fold up upon itself in a series of laps which are folded back against themselves as they are carried through the bath in the liquid medium.

At the exit end of each bath, the fabric is allowed to unfold, and as it is drawn from the bath it may open out and be withdrawn from the bath and fed to the next bath in the sequence in a somewhat open state, and when it is fed into the next bath it is again caused to double up on itself.

In passing through a sequence of baths, the baths preferably also perform the function of scouring the fabric to remove any wax and lubricants applied during the previous operations in which the cotton fibers are formed into yarns and the yarns are formed into fabrics. The initial baths in the sequence include scouring compositions which are effective to scour the fabric. Suitable fabric softeners and wetting agents may be applied separately or incorporated in the scouring compositions to enhance the scouring operation and also to enhance the ability of the fibers in the fabric to completely relax. Removal of the waxes and lubricants, and any other foreign matter entrained in the yarns assists in the relaxation of the fabric by removing the impediments to relaxation which the foreign matter may represent.

During the scouring treatment, the cotton fibers become saturated and swell, becoming shorter to assist in the relief of residual stresses which may be in the fabric as a result of the previous processing operations. During the immersion of the fabric in the liquid flow, the fabric achieves maximum shrinkage and relaxation. The relaxed fabric is then advanced to the next operation with care being taken to minimize imparting stresses to the fabric as would result from stretching. Of course, any handling of the fabric imparts stresses to it, but the transport of the fabric to the next stage is accomplished in a gentle fashion to avoid prolonged exposure to stretching or stress.

In the next operation, the fabric tube is flattened and opened to its full width without stretching, although some degree of transverse stretching must occur in order to achieve the full opening of the fabric tube. During the flattening, the fabric is maintained saturated with liquid so as to facilitate the flattening of the fabric with minimum application of stress. The flattened fabric is then put through apparatus to express free moisture from the fabric. The extraction of the free moisture in the tube may be performed by hydraulic, centrifugal, bubble or hydro extraction. In the present case, the apparatus comprises a padder with squeeze rolls. The rate of feed of the fabric through the squeeze rolls is coordinated with the rate of travel of the feed rolls to avoid application of longitudinal stress to the fabric as it is squeezed. The longitudinal stitch count at the exit end of the padder approximates the longitudinal stitch count at the entrance end, evidencing the absence of stretching in this operation.

By extracting the excess moisture from the fabric, the weight of the free moisture is removed from the fabric so that it may be fed into the next stage, the hot air drying stage, with minimum stretching. The hot air drying is accomplished between a pair of foraminous conveyors which support the fabric as it is subjected to the hot air in a fashion to assure freedom to contract and shrink at the same time to remove a large percentage of the moisture content to a condition of dryness where the moisture content is substantially less than 40%, for example approximately 20%. The dried fabric is then fed into a tumble dryer through a humidfying apparatus which stabilizes the moisture content of the fabric to approximately 40%, which has been found to be appropriate for achieving maximum effectiveness of fabric treatment in the tumble drying operation.

Figure 8:
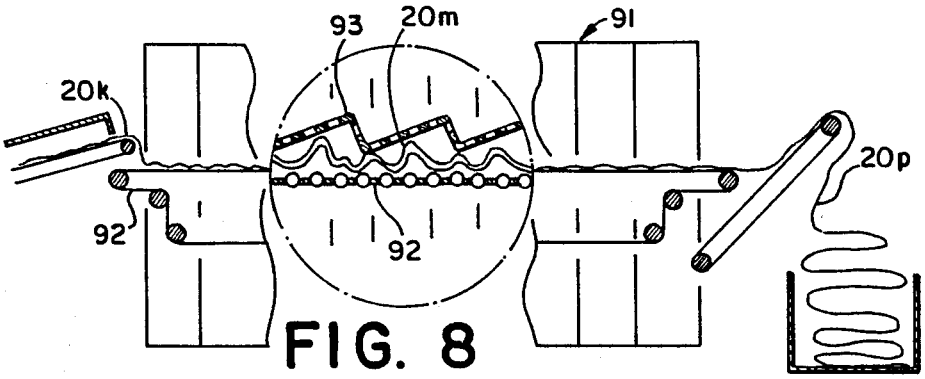
FIG. 8 is a diagrammatic view of the tumble dryer, with a portion magnified to illustrate the tumbling effect achieved in the apparatus.

In the tumble drying operation illustrated in FIG. 8, the fabric is carried on a conveyor and is subjected to forceful jets of air which cause the fabric to impinge against an overlying baffle. In the present instance, as described more fully hereinafter, the tumble dryer is compartmentalized into sequential sections and the heat and moisture content of the air supplied to each section is precisely controlled to obtain a moderate reduction in the moisture content of the fabric tube from the initial 40% moisture content at the entrance end of the tumble dryer to a final moisture content in the neighborhood of 5–8%. By gradually reducing the moisture content, the residual stresses in the fabric are released and relieved so that the fabric exiting from the tumble dryer may be collected in a fully relaxed state which is not subject to any substantial further shrinking.

Figure 2:
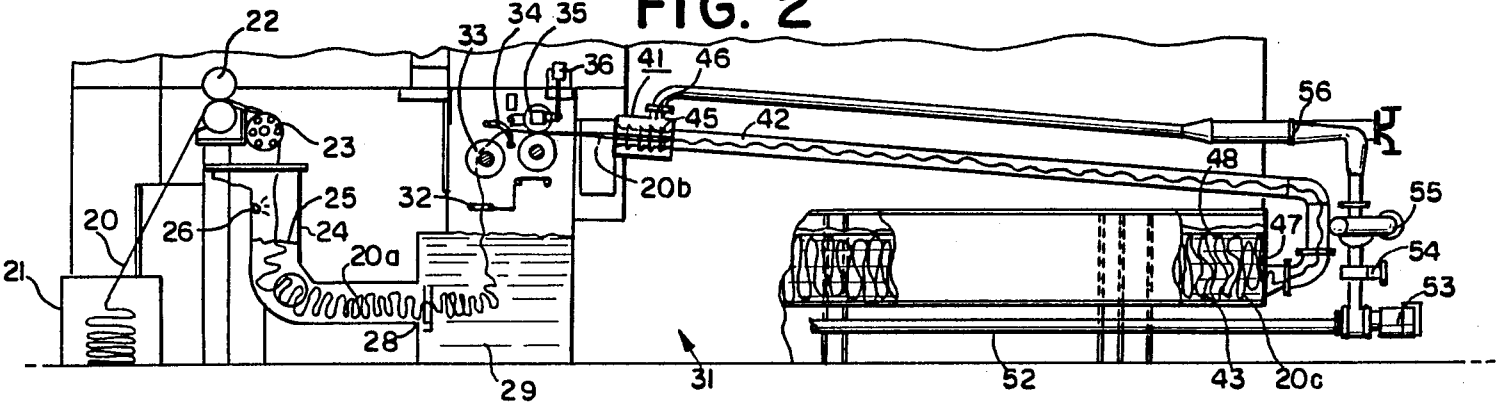
FIG. 2 is a drawing of apparatus for saturating the fabric and introducing it into the first washing stage.

In the treatment of the fabric, the fabric from the knitting machines is brought to the first station as shown in FIG. 2, for example in a carrier 21, from which it is withdrawn by pull rolls 22 and a feed reel 23 into the upright receiving leg of a J-box 24 having a liquid level, as indicated at 25. The J-box is filled with liquid, for example by a spray 26, preferably including a wetting agent, to insure saturation of the tubular fabric introduced from the feed reel 23. The tubular fabric accumulates in the curved bottom of the J-box as indicated at **20*a* and is discharged through an orifice 28 into a receiving tank 29 at the feed end of a relaxing and washing range designated generally at 31**.

In the illustrated embodiment of the invention, the relaxing and washing range is modeled after a unit manufactured in West Germany by Machinenfabrik Max Goller and identified as Model SV. The Model SV apparatus has been modified in substantial respects in order to perform the necessary operations found to be desirable to obtain maximum shrinkage of the fabric during the first stage without subjecting the fabric to stresses and strains which detract from the desired fabric treatment as set forth herein.

In setting up the operation of the washing range 31, the tubular fabric is allowed to accumulate in the receiving tank 29 so as to insure a dwell time of the fabric in the J-box which assures thorough penetration of the wetting agent into the fabric and saturation of the tubular fabric. The fabric is supplied in open-width folds, and care is exercised to avoid twisting the fabric tube as it passes through the J-Box 24 into the receiving tank 29. When a sufficient length of tubular fabric has accumulated in the bottom of the J-box and in the receiving tank 29, the leading end of the fabric is drawn up through a guide loop 32 over a feed pulley 33 and a knot detector 34 into feed rolls 35, the nip of which is regulated by a pressure controller 36 to control the amount of slippage between the fabric tube and the feed rollers. The tubular fabric is not twisted, and the guide loop 32 is sufficiently above the surface of the liquid in the receiving tank 29 so that the tube inherently balloons out as it leaves the tank and passes through the guide loop 32 in opened-out condition. The feed pulley 33 and feed rolls 35 flatten the opened-out tube and compact it, thereby providing a gentle "working" of the fabric to relieve stress. The controller 36 is responsive to the accumulation of material in the receiving tank 29 so as to maintain the desired quantity of material between the pull rolls 22 and the feed rolls 35.

From the feed rolls 35 the compacted tube of material, indicated at 20*b*, is introduced into the entrance portal 41 of a tubular conduit 42 extending from the feed rolls 35 to the entrance end of the first bath section 43 of the range. The entrance portal 41 of the conduit 42 has an annular jet insert 45 and a liquid inlet 46 to introduce a carrier liquid into the portal 41 surrounding the annular jet 46 at a sufficient pressure to cause the liquid to be directed inwardly toward the center of the conduit 43 and to flow longitudinally into the conduit 42. The flow in the conduit 42 has a rate of flow greater than the rate of feed of the tubular material at 20*b* from the feed rolls 35 into the portal. The effluent from the incoming annular jets entrains the compacted fabric tube 20*b* and carries it into the conduit 42 in a flow of liquid. The flow resistance in the conduit is sufficient to insure that there is a flowing body of liquid within the conduit through which the fabric tube passes. The operation of the feed rolls 35 is such as to push the fabric into the flow of liquid and cause the fabric to be advanced by the pushing by the fabric following it rather than by pulling. In this fashion, the fabric tube is compressed and compacted while saturated in the body of liquid, thereby further "working" the fabric to facilitate the release of any stresses or strains which may have been built into the fabric during the previous operations.

Figure 3:
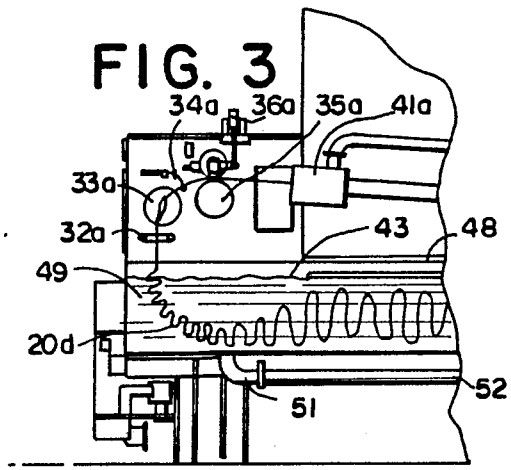
FIG. 3 is a fragmentary view of a relaxing and washing range showing the transfer of the fabric from one washing stage to the next.

At the opposite end of the range 31, the conduit 42 empties into a bath 43, and the liquid flowing through the conduit carries with it the fabric tube. In start-up, the fabric in the bath 43 is held against withdrawal so that the fabric bunches up upon itself in overlapping folds as indicated at 20*c* in FIG. 2. In order to maintain the material 20*c* beneath the surface of the bath 43, longitudinal guide rods 48 are placed in the bath subjacent the surface, and these guide rods are preferably comprised of polytetrafluoroethylene (Teflon TM) and oscillated longitudinally so as to facilitate and assist in the migration of the folds of material 20*c* leftward toward the exit end of the bath 43. The liquid flowing through the conduit 42 into the entrance end of the bath 43 provides a leftward flow of liquid within the bath, as seen in FIG. 2, which assists in the migration of the fabric from the entrance end at 47 to the exit end. The exit end of the bath 43 is shown in FIG. 3, and the fabric is advanced at the exit end into a tank 49 similar to the receiving tank 29.

At the exit end, the tank 49 also serves as the entrance end for a succeeding section of the washing range. To this end, there is a guide loop 32*a* through which the fabric tube is drawn upwardly by feed pulleys 33*a* through a knot detector 34*a*, feed rolls 35*a*, which are controlled at 36*a* to advance the material into the portal 41*a* of the next section of the machine. Care is exercised to avoid twisting the tubular fabric, so that it may balloon out as it is drawn out of the tank 49 through the loop 32*a*.

In the preferred embodiment of the invention, the washing range 31 has eight baths, each within a separate section of the machine so that the fabric tube is caused to travel sequentially through all eight baths. In the initial bath, the liquid bath includes washing and scouring components which serve to thoroughly cleanse the fabric tube and cause the removal of any waxes, lubricants or other foreign matter which may be entrained in the fabric. Preferably, the scouring bath is controlled to a resident temperature of 200° F. As shown in FIG. 3, water is withdrawn from the tank 49 through a drain indicated at 51 and is directed rearwardly through a conduit 52 to a pump 53, a mixing control 54, a filter 55 and a steam heat exchanger 56 to feed the inlet 46 of the inlet portal 41 for the conduit 42. Thus, the liquid in the bath in each section is recirculated and may be replenished and/or enriched through the mixing control 54. The mixing control 54 may introduce fresh water or fresh cleansing components into the recirculating flow, and may also use washing or rinsing liquid from subsequent sections in lieu of fresh water in order to conserve water and energy. The liquid levels in the apparatus are maintained by discharge of a similar quantity of liquid, preferably from the receiving tank 29. In this way, there is an overall countercurrent flow of treating liquid within the washing range.

Figure 4:
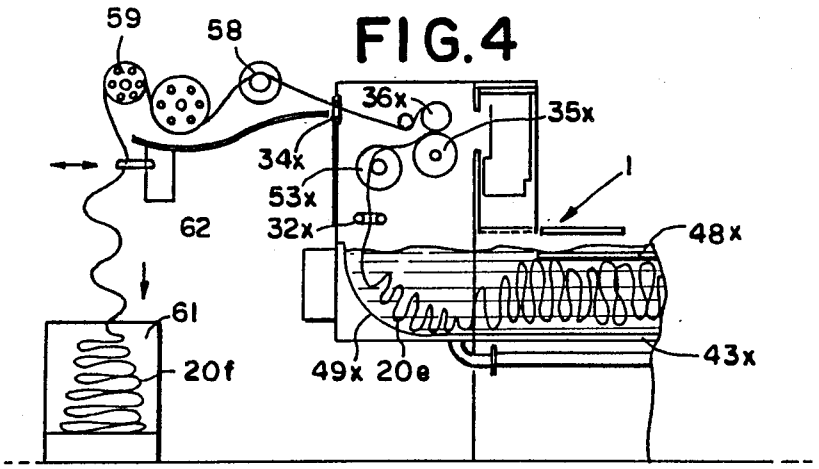
FIG. 4 is a fragmentary view illustrating the removal of the fabric from the final washing stage and the depositing of the fabric in a carrier for transport to a next station for flattening.

FIG. 4 illustrates the arrangement for withdrawing the fabric from the washing range 31. To this end, the final bath 43*x* discharges the fabric, as indicated at 20*e*, from under the guide bars 48*x* into a scray 49*x*. From the scray 49*x*, the fabric is withdrawn through a guide loop 32*x*, around a feed pulley 33*x*, through feed rollers 35*x* and around the upper nip roller 36*x* of the feed rollers 35*x* through a knot detector 34*x* over a feed pulley 58 around feed reels 59 into a carrier 61, the fabric, as indicated at 20*f*, being fully saturated. To facilitate folding, a swinging plaiter 62 may be used below the feed reels 59 to deposit the fabric into the carrier 61.

The fabric in the carrier 61 has been thoroughly scoured and rinsed, and if chemical additives are required in the fabric, they may be added in one of the baths through which the fabric is passed. The temperature and the composition of the liquid in each of the baths is monitored and adjusted to insure maximum efficiency in the scouring and rinsing operations so that the fabric in the carrier 61 is subjected to its maximum shrinkage and is relaxed to introduction of stress or strains in the fabric. It should be noted that in the tanks 29 and 49, the fabric is free to open out. As the fabric is drawn up through the loops 32 and 32*a*, it tends to balloon below the loops so as to provide further "working" of the fabric as it is transferred from one bath to the next and from one section of the range to the next.

In the present instance, there is a series of eight separate baths. The accumulation of the fabric in each of the baths of the several sections of the washing range 31 provides a dwell time on the order of 20 minutes in each of the first four baths, and 10 minutes in each of the final four baths. The dwell time is set up during the initial loading of the range 31, with twice the length of fabric in the first four sections than in the final four sections. In the present case, all sections are of the same length, so that the fabric is more densely packed into the first four baths than in the final four baths. In other words, any segment of the fabric 20 introduced into the washing liquid at 20*a* will exit the washing range at 20*e* approximately 120 minutes later.

Since the fabric shrinks as it travels through the range 31, the feed rolls 35 accommodate to the shrinkage by releasing the pressure through the controller 36. The shrinkage in the relaxing and washing range will normally approximate 20%, i.e. if the longitudinal cell count of the thermal fabric at 20 is 5.25 cells per inch, the cell count increases to 5.75 after the first bath and gradually increases to over 6.00 as the foreign matter is scoured from the fabric and the fabric is subjected to soft rinsing in final baths. The crosswise cell count may increase to some degree as the fabric travels through the series of baths, but the lateral contractile forces in the knitted tube are not as dominant as the longitudinal contractile forces.

Figure 5:
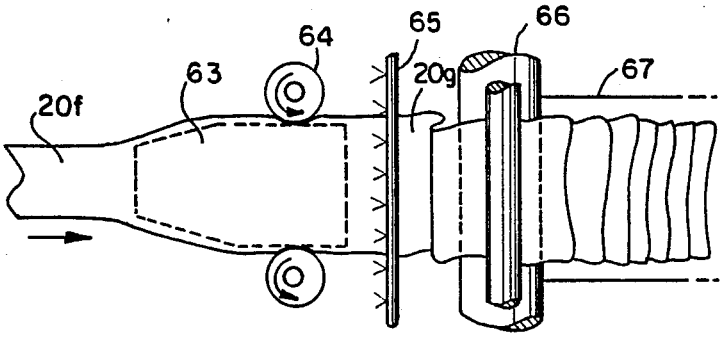
FIG. 5 is a fragmentary plan view of the station showing a padder in which the fabric tube is flattened and squeeze-dried.

The fabric 20*f* in the carrier 61 is transferred to the next station where it is flattened in open tubular width and squeeze dried. As shown in FIG. 5, the fabric 20*f* is fed through a padder which is operated at a rate to avoid application of longitudinal tension to the fabric tube. The fabric tube is fed over a floating shoe 63 which is positioned between counter-rotating rolls 64 which advance the fabric over the shoe at a rate which does not stretch it longitudinally. Beyond the shoe, the fabric at 20*g* is sprayed with a liquid by a spray manifold 65 to restore full saturation to the fabric in advance of the squeeze rolls 66 which deposit the fabric on a slow moving conveyor 67 in overlapping folds for ultimate depositing in a carrier 68 (not shown in FIG. 5). The squeeze rolls 66 extract the free water from the fabric so that the fabric deposited on the conveyor 67 is saturated, but without substantial free water therein. The tubular fabric in the carrier 68 is flattened so that the fabric consists of the two layers of the tube in open tubular width.

Figure 6:
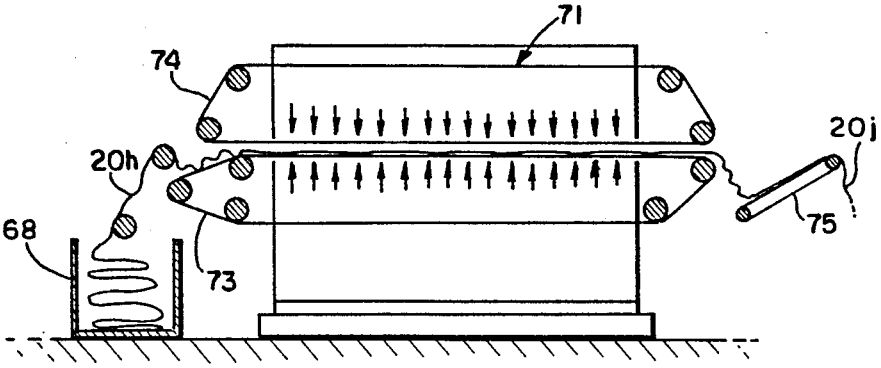
FIG. 6 is a schematic view of the first stage of the drying.

The carrier 68 transfers the fabric to the entrance end of an air dryer 71, as shown in FIG. 6. The fabric is withdrawn from the carrier 68 as shown at 20*h* and is deposited on the lower belt 73 of the air dryer. A hold-down belt 74 overlies the belt 73 and travels concurrently with the belt 73 to advance the fabric loosely deposited on the belt through the air dryer housing in which air is impinged against the fabric on the carrier belt 73 from both sides and is discharged laterally so as to evaporate the moisture contained in the fabric.

The air dryer 71 is designed to receive a plurality of flattened tubes side by side so as to treat the tubes concurrently and reduce their moisture content to the range of 20–40%, preferably drying the tubes to about 20% moisture content. The conveyors 73 and 74 deposit the fabric tubes on a cooling belt 75. The apparatus shown in FIG. 6 is a dryer made in Switzerland by Santex AG and which has been modified to minimize the longitudinal tension applied to the tubes by the dryer at the entrance and exit ends.

Figure 7:
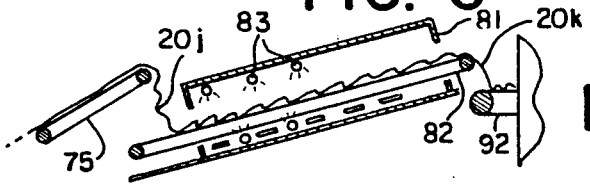
FIG. 7 is a view of apparatus intermediate the first and second stages of the drying for controlling the moisture content of the fabric, and specifically for uniformly restoring the fabric to a 40% moisture content.

From the cooling belt 75, the dried fabric at 20*j* is fed into a steam chest 81 on a foraminous conveyor 82 (FIG. 7). The tube 20*j* is deposited on the conveyor in loose folds and is carried through the steam chest 81 where it is subjected to steam and water sprays at 83 which are designed to stabilize the moisture content of the fabric exiting the steam chamber at 20*k* at a uniform moisture content of approximately 40% moisture content. The sprays 83 are very very fine so as to create a mist enveloping the fabric on the top and bottom. Steam coils 85 within the chest 81 generate a steam atmosphere which restores the moisture content of the fabric to the desired level. A fabric of this moisture content is capable of further relaxation and shrinkage when subjected to agitation under dry heat. In this condition, the fabric from the steam chamber at 20*k* is deposited on a perforated tray conveyor 92 of a tumble dryer apparatus 91.

The fabric 20*k* is deposited in overlapping folds on the conveyor 92 so that the fabric is free to be tumbled on the conveyor as it is conveyed through the several sections of the tumble dryer 91. The tumble dryer 91 has a plurality of sections through which the conveyor 92 carries the fabric. In each section of the dryer 91, as shown in the enlarged portion of FIG. 8, jets of air are directed upwardly through the conveyor to impinge against the underside of the fabric 20*m* reposed on the conveyor 92. Overlying the path of the conveyor there is a saw-tooth perforated baffle plate 93 which is sufficiently close to the conveyor 92 that the air jets directed upwardly through the conveyor cause the fabric 20*m* to impinge against the undersurface of the baffles 93 and the saw-tooth configurations of the baffles bounce the fabric down against the conveyor 92 so as to effect a tumbling action on the fabric as it is conveyed through the dryer in a continuous length.

Each section of the dryer has the humidity and temperature in the air jets controlled so that the drying effect of each section is likewise controlled to provide a low gradient in the drying effect as the fabric tube is conveyed through the successive sections. As a result, the dryer achieves a uniform gradual drying of the several fabric tubes traveling through the dryer side-by-side. Since the fabric tubes entering the dryer are uniformly stabilized at a 40% moisture content, the fabric tubes exiting the dryer are uniformly dried to the desired final moisture content for subsequent operations. The fabric exiting the dryer at 20*p* exhibits the fully pre-shrunk characteristics which have been found desirable for fabrication into garments which do not need to be further shrunk for distribution and sale.

From the foregoing, it is apparent that the present invention provides a method for treating a knitted tube in a continuous length so as to achieve a uniformly controlled shrinkage of the fabric which permits the fabric to be made into garments which may be designated "pre-shrunk", without actually exposing the finished garments to shrinkage.

While a particular embodiment of the present invention has been herein illustrated and described, it is not intended to limit the invention to such disclosure but changes and modifications may be made therein and thereto within the scope of the following claims.

I claim:

1. A method for pre-shrinking tubular knit fabrics comprising at least 40% cotton comprising the steps of:

forming the fabric into an elongated tube, continuously feeding the tube lengthwise into a first bath of liquid, and retaining each part of the tube in the bath of liquid for a sufficient length of time to completely saturate the fabric of the tube;

continuously withdrawing the tube from said first bath and feeding it longitudinally into a sequence of baths by positively feeding the tube into the bath at its entrance end, maintaining said tube immersed in said bath throughout its length, withdrawing said fabric from the opposite end of each bath section by continuously withdrawing the fabric vertically from the discharge end and transferring it, without substantial stretching to the entrance end of the next bath section for positive feeding of the fabric into the next bath section;

controlling the feed and discharge of the fabric to avoid longitudinal stress on the tube during its travel through the bath section, assuring longitudinal compression or slackening of the fabric in its travel through each section;

thereafter arranging said length of tubular fabric into a flattened tubular shape having only two fabric thicknesses throughout;

maintaining said fabric saturated with liquid throughout said arranging step;

feeding said flattened tube into a dryer so as to reduce the moisture content to a range of 20–40% moisture content;

thereafter subjecting the fabric to heat and moisture to stabilize its moisture content in the range of 35–45%; and feeding the continuous length of fabric into a tumble dryer section and causing the fabric to be repeatedly impacted while slack and removed from longitudinal tension, and while subjected to heat and dry air and continuing the treatment in the tumble dryer for a period to reduce the residual shrinkage of the fabric to less than 8%.

2. A method according to claim 1 wherein said tube is positioned in said baths in a series of folds doubled back on themselves so as to occupy a substantial part of the height and width of the liquid in said bath.

3. A method according to claim 1 wherein the immersion of said tube in said sequence of baths is maintained for a time period to assure thorough saturation of the fabric and its constituent yarns to enable the cotton fibers in said constituent yarns to become saturated and swell, thereby relieving any residual stresses imparted to said yarns during the previous operations in which said fibers are formed into yarns and said yarns are formed into a fabric.

4. A method according to claim 3 wherein at least one of said baths includes a fabric softener to enhance the stress relief, and said time period is approximately 120 minutes.

5. A method according to claim 1 wherein the step of maintaining said tube immersed is achieved by providing oscillating immersion bars adjacent the upper surfaces of said baths in said sequence, and feeding said tube into said baths beneath said oscillating immersion bars.

6. A method according to claim 1 wherein said transfer of the fabric tube from the discharge end of one bath section to the entrance end of the next bath section is effected by providing a closed conduit between said discharge end and said entrance end, spraying a liquid carrier medium into the entrance end of said conduit through an annular jet at a rate of flow to assure liquid flow through the conduit at a linear rate higher than the rate of feed of the fabric tube, and causing said tube to pass axially the center of said annular jet so as to be carried by the liquid flow through said closed conduit.

7. A method according to claim 6 wherein said liquid carrier medium sprayed through said jet is supplied from the liquid in a bath section which is subsequent to the conduit.

8. A method according to claim 1 wherein the initial baths in said sequence of bath sections include scouring components to scour the fabric to remove oils and waxes and foreign matter entrained in the fabric, and the final baths in said sequence rinse the fabric to remove the scouring compositions.

9. A method according to claim 1 wherein said step of stabilizing the moisture content of the fabric in advance of the tumble dryer section comprises the step of depositing the fabric on a conveyor, advancing the conveyor through a closed chamber and spraying a mist of water against the fabric on the conveyor in an atmosphere of steam in the closed chamber to thereby stabilize its moisture content.

10. A method according to claim 1 wherein the fabric is conveyed on a slotted conveyor in said tumble dryer section and hot and dry air is blown upwardly through said conveyor to lift the fabric up from the conveyor.

11. A method according to claim 10 wherein said slotted conveyor travels below saw-toothed baffle plates fixed adjacent said conveyor so that the lifted fabric impinges against said baffle plates.

12. A method for pre-shrinking thermal knit fabrics characterized by air-entrapping cells on one or both sides in longitudinal and transverse rows and comprising at least 40% cotton comprising the steps of:

forming the fabric having a given longitudinal cell count into an elongated tube, continuously feeding the tube lengthwise into a first bath of liquid, and retaining each part of the tube in the bath of liquid for a sufficient length of time to completely saturate the fabric of the tube and cause the longitudinal cell count to increase;

continuously withdrawing the tube from said first bath and feeding it longitudinally into a sequence of baths by positively feeding the tube into the bath at its entrance end, maintaining said tube immersed in said bath throughout its length, withdrawing said fabric from the opposite end of each bath section by continuously withdrawing the fabric vertically from the discharge end and transferring it, without substantial stretching to the entrance end of the next bath section for positive feeding of the fabric into the next bath section without reducing the longitudinal cell count;

controlling the feed and discharge of the fabric to avoid longitudinal stress on the tube during its travel through the bath section, assuring longitudinal compression or slackening of the fabric in its travel through each section;

thereafter arranging said length of tubular fabric into a flattened tubular shape having only two fabric thicknesses throughout;

maintaining said fabric saturated with liquid throughout said arranging step and maintaining the longitudinal cell count of the saturated fabric not substantially less than the longitudinal cell count prior to flattening;

feeding said flattened tube into a dryer so as to reduce the moisture content to a range of 20–40% moisture content without substantially reducing the longitudinal count;

thereafter subjecting the fabric to heat and moisture to stabilize its moisture content in the range of 35–45%; and feeding the continuous length of fabric into a tumble dryer section and causing the fabric to be repeatedly impacted while slack and removed from longitudinal tension, and while subjected to heat and dry air and continuing the treatment in the tumble dryer for a period sufficient to increase the longitudinal cell count and to reduce the residual shrinkage of the fabric to less than 8%.

13. Apparatus for preshrinking tubular knit fabrics comprising at least 40% cotton, said apparatus comprising in combination:

a J-box for receiving the fabric in elongated tubular form having an upright receiving leg and a curved bottom, means to feed the fabric into a curved bottom through said upright leg and means to wet the fabric with a liquid in said upright leg, said liquid collecting in said curved bottom to a height above the level of the fabric in the curved bottom to enable the fabric to be totally immersed and become saturated with the liquid;

a relaxing and washing range connected to said J-box having an inlet tank to receive the fabric from said curved bottom of the J-box and a series of elongated baths with means to feed the fabric sequentially through said baths, said fabric feeding means for each bath comprising a tubular conduit having an inlet portal forming an annular jet for the introduction of conveying liquid into the center of the conduit in an annular spray directed generally longitudinally of the conduit, and means to feed the fabric into the center of said portal so as to be introduced into the flow of liquid from said annular jet, the opposite end of said conduit directing the fabric into one end of the associated bath, said bath having holddown bars to maintain the tubular material submerged within said bath, said bath at the opposite end adapted to discharge the fabric into a receiving tank underlying the inlet portal of the conduit for the next bath in said series, whereby the fabric may be lifted into the portal from said receiving tank, and means to discharge the fabric from the receiving tank of the last bath in said series in a saturated state;

an extracting apparatus operable to receive the fabric from the discharge means of said relaxing and washing range to straighten the fabric and flatten it into open-width configuration and having means to maintain the fabric saturated while it is straightened and flattened, and means to extract free moisture from said saturated fabric, said apparatus including feed rolls to advance the fabric through the apparatus at a rate to maintain the longitudinal stitch count of the fabric substantially the same at the entrance and exit ends of said extracting apparatus;

an air dryer operable to receive the fabric from said extracting apparatus, said air dryer including means to support and convey the fabric through the dryer in a relaxed state without application of substantial longitudinal tension and means to discharge dry and hot air against and through the fabric to reduce its moisture content to less than 40%;

a steam chest having a foraminous conveyor and misting sprays to receive the fabric from the hot air dryer and to convey the fabric on said conveyor past said sprays while on the conveyor, said steam chest having control means providing a controlled steam atmosphere to stabilize the fabric exiting the steam chest at a moisture content of 40%; and a continuous tumble dryer to receive the stabilized fabric from the steam chest, said tumble dryer including a series of dryer sections with a foraminous conveyor for conveying the fabrics sequentially through said sections, means to deposit the fabric on the conveyor at the entrance end of said tumble dryer in loose folds and means in each section to supply and impinge air against the fabric with a sufficient force to cause the fabric on the conveyor to tumble within each section of said series, and means to control the heat and humidity of the air supplied in each section, to thereby control the dryness of the fabric within each section, said apparatus discharging the fabric at a uniform dryness in the range of 6–10%.

* * * * *

UNITED STATES PATENT AND TRADEMARK OFFICE

CERTIFICATE OF CORRECTION

PATENT NO. : 4,922,567

DATED : May 8, 1990

INVENTOR(S) : Robert A. Miller

It is certified that error appears in the above-identified patent and that said Letters Patent is hereby corrected as shown below:

Column 6, line 62, after "to", insert the following words: --the greatest degree possible so as to avoid--.

Signed and Sealed this

Ninth Day of July, 1991

*Attest:*

*Attesting Officer*

HARRY F. MANBECK, JR.

*Commissioner of Patents and Trademarks*